United States Patent [19]

Munker

[11] 4,299,357

[45] Nov. 10, 1981

[54] CENTERING PLATE FOR SUPPORTING A YARN CARRIER TUBE

[75] Inventor: Gert Munker, Wachtendonk, Fed. Rep. of Germany

[73] Assignee: Palitex Project Company GmbH, Krefeld, Fed. Rep. of Germany

[21] Appl. No.: 135,516

[22] Filed: Mar. 31, 1980

Related U.S. Application Data

[63] Continuation of Ser. No. 58,727, Jul. 18, 1979, abandoned.

[30] Foreign Application Priority Data

Jul. 24, 1978 [DE] Fed. Rep. of Germany ..... 2832444

[51] Int. Cl.[3] ..... B65H 54/54; B65H 65/00

[52] U.S. Cl. ..... 242/18 DD; 242/18 PW; 242/129.51

[58] Field of Search ..... 242/18 DD, 18 PW, 18 A, 242/129.51, 125, 125.1, 125.2

[56] References Cited

U.S. PATENT DOCUMENTS

| | | | |
|---|---|---|---|
| 2,651,479 | 9/1953 | Bauer | 242/129.51 |
| 3,717,291 | 2/1973 | Adams et al. | 242/125.1 X |
| 3,801,030 | 4/1974 | Kobatake et al. | 242/18 PW X |
| 4,018,401 | 4/1977 | Cunningham | 242/18 PW X |
| 4,094,476 | 6/1978 | Schmidt et al. | 242/125.2 |
| 4,165,055 | 8/1979 | Dee | 242/125.2 |

FOREIGN PATENT DOCUMENTS

| | | | |
|---|---|---|---|
| 958394 | 11/1974 | Canada | 242/18 PW |
| 949900 | 9/1956 | Fed. Rep. of Germany . | |
| 2312609 | 10/1974 | Fed. Rep. of Germany . | |
| 2332327 | 1/1975 | Fed. Rep. of Germany . | |
| 2536477 | 1/1976 | Fed. Rep. of Germany . | |
| 2647544 | 4/1978 | Fed. Rep. of Germany | 242/125.1 |
| 450855 | 4/1968 | Switzerland . | |

*Primary Examiner*—Stanley N. Gilreath
*Attorney, Agent, or Firm*—Bell, Seltzer, Park & Gibson

[57] ABSTRACT

The invention relates to a centering plate for rotatably mounting a yarn carrier tube in a take-up assembly of a textile yarn processing machine. The centering plate is of an improved construction for providing reliable automatic or manual securement of a yarn end during a threadup operation, and comprising a hub extending axially into and supporting one end portion of the carrier tube and an adjoining larger diameter circumferential flange positioned in engagement with the end of the carrier tube. A circumferential yarn securement channel is provided adjacent to the flange and is defined by a pair of opposing surfaces positioned so as to provide a continuously narrowing cross-sectional area in said channel for wedging and securing a yarn therein.

6 Claims, 8 Drawing Figures

CENTERING PLATE FOR SUPPORTING A YARN CARRIER TUBE

CROSS-REFERENCE TO RELATED APPLICATION

This application is a continuation of earlier-filed copending application Ser. No. 058,727 filed July 18, 1979, now abandoned.

FIELD OF THE INVENTION

This invention relates to yarn take-up mechanism of a textile yarn processing machine, and more particularly to an improved centering plate for mounting a yarn carrier tube or bobbin tube in a take-up mechanism, and which is constructed for providing more reliable automatic or manual securement of a yarn end to the tube.

BACKGROUND OF THE INVENTION

In a textile yarn processing machine where yarn is wound into a package at a take-up mechanism, it is necessary when initially threading the yarn to the take-up mechanism to secure the yarn end in some manner in order to begin winding the yarn onto the carrier tube or bobbin tube. Heretofore, the securement of the yarn end has been accomplished in various ways.

For example, one prior method involves the use of a special carrier tube having a slot in one end thereof into which the yarn end is inserted during the thread-up operation. With the yarn end so positioned, the rotation of the carrier tube results in the yarn being wound onto the carrier tube. Another prior technique, as disclosed for example in German Gebrauchsmuster 7,126,191 requires that the yarn end be positioned between the end of the carrier tube and the centering plate upon which the tube is mounted, and frictionally held in place therebetween.

These prior yarn securement techniques have several disadvantages and limitations. Not only are they unsuited for automated thread-up operations, but in manual operations they prolong the thread-up procedure since it is necessary for the operator either to search for the slot on the carrier tube where the yarn is to be inserted, or to manually shift the carrier tube axially away from the centering plate in order to position the yarn therebetween. Additionally, after extended use, the end faces of the yarn carrier tubes tend to become damaged, and it is then no longer possible to insure reliable securement of the yarn end.

In German Offenlegungsschrift No. 2,312,609, a yarn securement arrangement is disclosed wherein the centering plate is mounted so as to be axially displaceable with respect to a clamping plate to expose a gap therebetween into which a yarn may be positioned and then clamped in place. When the yarn package has been fully formed and ready for removal from the take-up mechanism, the centering plate is again moved axially away from the clamping plate so that the yarn end is released. A somewhat similar arrangement for clamping the yarn end has also been disclosed in German Offenlegungsschrift No. 2,332,727.

These arrangements, like those noted earlier, are not suited for automated thread-up operations. Also, the arrangement disclosed in German Offenlegungsschrift No. 2,312,609 is relatively expensive to construct because of the necessary relative movements between the centering plate and the clamping plate.

In German Patent Specification No. 949,900, there is disclosed a winding mechanism for cables wherein the securement of the cable is intended to be accomplished by providing a circumferential groove in the carrier tube itself. However, unless the cable is pulled securely into the groove, the cable may slide out relatively easily when winding begins.

In Swiss Pat. No. 450,855, there is disclosed an arrangement for securing the end of a yarn for winding on a carrier tube or bobbin in which there is a groove or channel in which the yarn is inserted, and wherein at least one projection is provided projecting into the groove for wedging and holding the yarn in place. However, in spite of this projection, there exists a risk that the yarn may slip out of the groove when winding begins unless the yarn is carefully and securely inserted initially.

An arrangement which is much simpler than the prior devices previously described, and which is intended for both automatic and manual securement of the yarn end, is disclosed in commonly-owned German Patent Specification No. 2,536,477. In this device, the centering plate has a circumferentially extending yarn securement channel which is provided with opposing pairs of wedge shaped grooves in the opposing side walls of the channel for wedging or jamming a yarn therebetween. The grooves on one side wall of the channel extend in the direction of rotation of the centering disc and the opposing grooves on the other side of the channel extend opposite the direction of rotation. The side wall closest to the carrier tube is provided in the zone of each set of wedge shaped grooves with an undercut protrusion or nose facing in the direction of rotation of the centering plate. The principal function of the protrusion is to facilitate the transfer of the yarn from the yarn securement channel to the carrier tube when winding begins.

SUMMARY OF THE INVENTION

The present invention is an improvement over the aforementioned prior art yarn securement arrangements, in particular, the device described in the previously mentioned German Patent Specification No. 2,536,477.

It is an object of this invention to provide a centering plate which is of simpler design and construction than the devices of the prior art, and which can insure the reliable securement of the yarn end by wedging or jamming action so as to thus be particularly well suited both for automatic and for manual thread-up operations.

It is a further object of this invention to provide an improved centering plate of the type described which is constructed so as to insure that the transfer of the yarn from the yarn securement channel to the carrier tube can proceed smoothly while treating the yarn in a delicate manner.

In accordance with the invention there is provided a centering plate for mounting a carrier tube, the centering plate comprising a hub extending axially into and supporting one end of the carrier tube, and an adjoining larger diameter circumferential flange positioned in engagement with the end of the carrier tube for limiting axial movement thereof. The centering plate further includes a circumferential channel located adjacent to the flange and which is defined by a pair of opposing surfaces positioned for wedging and securing a yarn therebetween, with one of the surfaces comprising a perpendicularly extending face of the flange, and with the other surface of the channel, as a whole extending obliquely with respect to the axis of the centering plate to thus provide a continuously narrowing cross-sectional area in the channel in the direction of rotation of the centering plate for wedging and securing a yarn therein.

The other surface of the channel may also be provided with the yarn clamping grooves extending in a direction opposite the direction of rotation of the centering plate and slanting downwardly toward the base of the channel. These yarn clamping grooves serve to assist in achieving a firm and reliable wedging or jamming securement of the yarn in the yarn securement channel.

Preferably, the centering plate is so constructed that the flange is of an outside diameter corresponding substantially to the outside diameter of the carrier tube to thus permit a smooth transfer of the yarn from the channel to the carrier tube when the yarn is initially wound onto the carrier tube.

This simplified arrangement for the centering plate, and for the yarn securement channel, has been found to insure a highly reliable securement of the yarn end, whether a yarn end is delivered to the channel by an automatic threading mechanism or manually, and regardless of whether the yarn is delivered while the centering plate is rotating or stationary.

This arrangement further insures that the yarn, once secured to the centering plate, will be transferred to the carrier tube in a smooth and troublefree manner, with the yarn passing directly over the flange and onto the carrier tube since the flange is of the same outside diameter as the carrier tube itself.

BRIEF DESCRIPTION OF THE DRAWINGS

Some of the objects, features and advantages of the invention having been set forth, other objects, features and advantages will appear when the description proceeds when taken in connection with the accompanying drawings, in which.

DESCRIPTION OF ILLUSTRATED EMBODIMENT

For purposes of illustration, and in order to provide a full and complete description of the present invention and how it may be used, the present invention is illustrated and described herein as applied to a two-for-one twister textile yarn processing machine. However, it is to be understood that the present invention is also applicable to various other types of textile yarn processing machines, as well as to other types of machines for winding continuous strand material.

Figure 1:
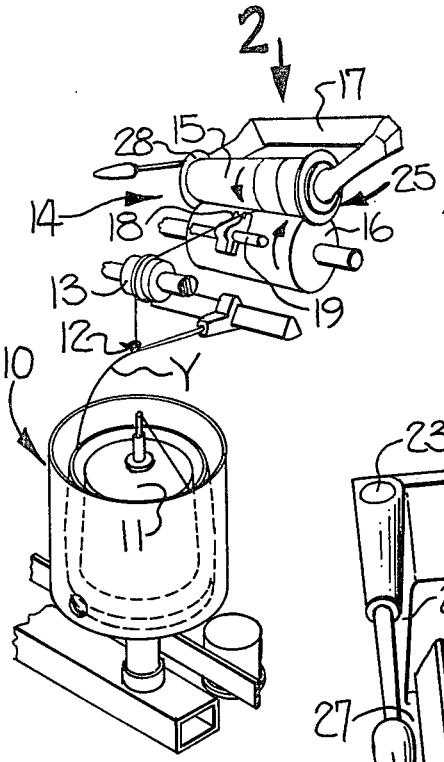
FIG. 1 is a somewhat schematic, perspective view of one spindle assembly of a textile yarn processing machine and a cooperating yarn take-up mechanism utilizing the improved centering plate of the present invention.

Referring now to the drawings, there is illustrated in FIG. 1 a schematic perspective view of a single spindle assembly, generally indicated at 10, of a two-for-one twister textile yarn processing machine. Conventionally, a plurality of these spindle assemblies are provided in side-by-side relationship in two rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

For purposes of the present invention, it is sufficient to note that the spindle assembly 10 is of hollow construction and contains an elongate yarn passageway extending therethrough. Yarn Y from a yarn supply package 11 which is centrally mounted in the spindle assembly, is directed downwardly through the elongate yarn passageway, and then passes upwardly forming a balloon of yarn rotating about the supply package 11. The yarn Y is then directed through a yarn guide eyelet 12 which limits the upper end of the rotating balloon of yarn, over a pretake-up roll 13 and to a take-up mechanism, generally indicated by the reference character 14, where the yarn is wound onto a hollow carrier tube or bobbin tube 15 to form a yarn package. As is well understood by those with ordinary skill in the art, a two-for-one twist is inserted in the yarn Y during the above-noted path of travel.

Figure 2:
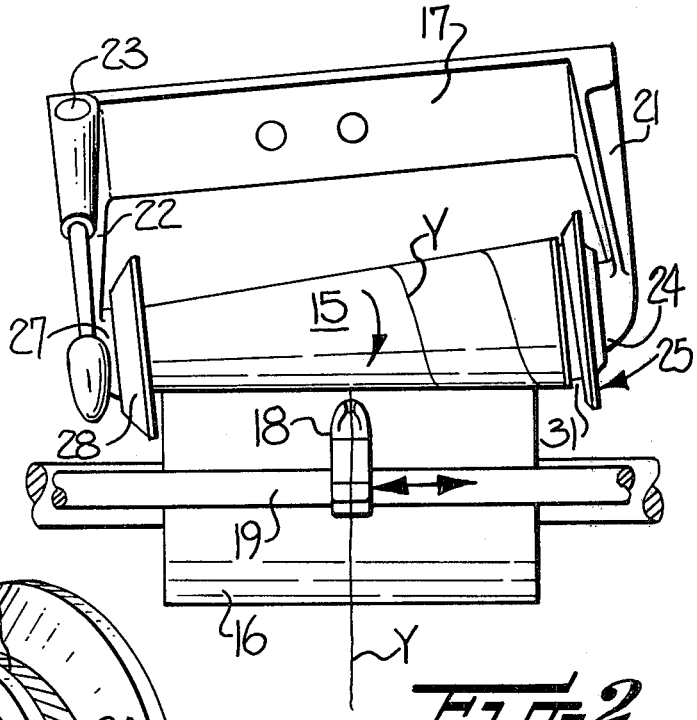
FIG. 2 is an enlarged elevational view of the take-up mechanism, as generally seen from the arrow 2 in FIG. 1.

The take-up mechanism 14 includes a friction drive roll 16 which is rotatably driven in the direction indicated by the arrow in FIG. 1 and a two-armed cradle 17 which is constructed for mounting the carrier tube 15 above the friction drive roll 16 with the surface of the carrier tube (or the yarn which is wound thereon) engaging the friction drive roll 16 so as to impart rotation to the carrier tube 15 at a uniform peripheral velocity for winding the yarn Y onto the carrier tube 15. During the winding of the yarn on the carrier tube, the yarn is traversed in a conventional manner by a yarn traversing guide 18, which is carried by a traverse bar 19 driven in a reciprocating manner as indicated by the double-ended arrow in FIG. 2.

Figure 6:
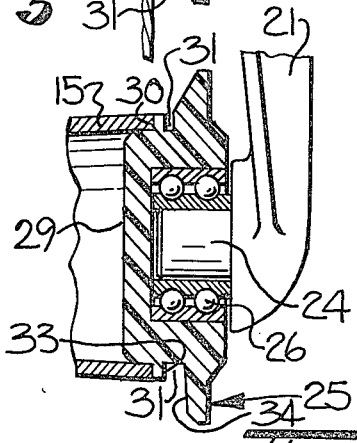
FIG. 6 is a cross-sectional view of the centering plate taken substantially along the line 6—6 of FIG. 5.
Figure 7:
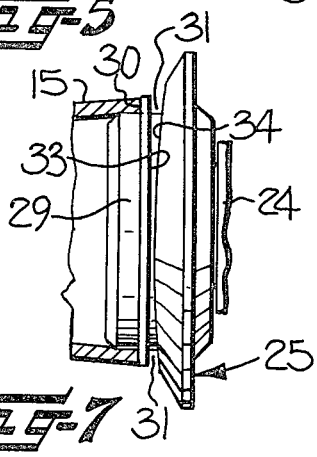
FIG. 7 is a view of one side of the centering plate as seen from the arrow 7 in FIG. 5.
Figure 8:
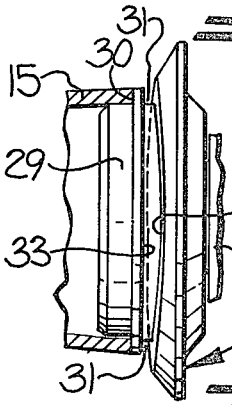
FIG. 8 is a view of the opposite side of the centering plate, as seen from the arrow 8 in FIG. 5.

The two-armed cradle 17 includes a fixed arm 21 and an arm 22 which is mounted for pivotal movement about an axis 23. The free end of the fixed arm 21 carries a holder 24, to which a centering plate 25 is rotatably mounted by suitable bearings 26 (FIG. 6). The pivotable arm 22 similarly carries a holder 27 at the free end thereof, to which a centering plate 28 is rotatably mounted. The distance between the two centering plates 25, 28 can be widened by pivoting the pivotable arm 22 outwardly, and in this way allowing a carrier tube 15 to be positioned between the two centering plates 25, 28 and mounted for rotation therewith.

Figure 3:
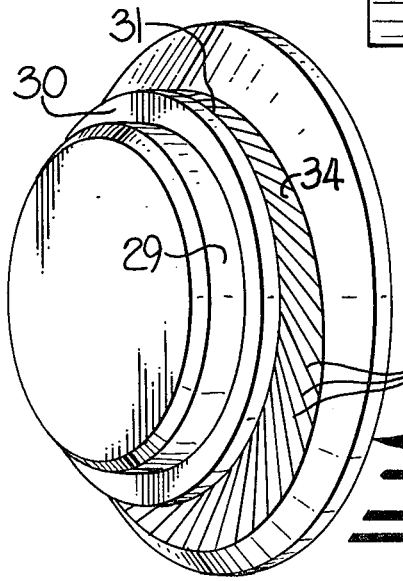
FIG. 3 is an enlarged perspective view of the improved centering plate of the invention.
Figure 4:
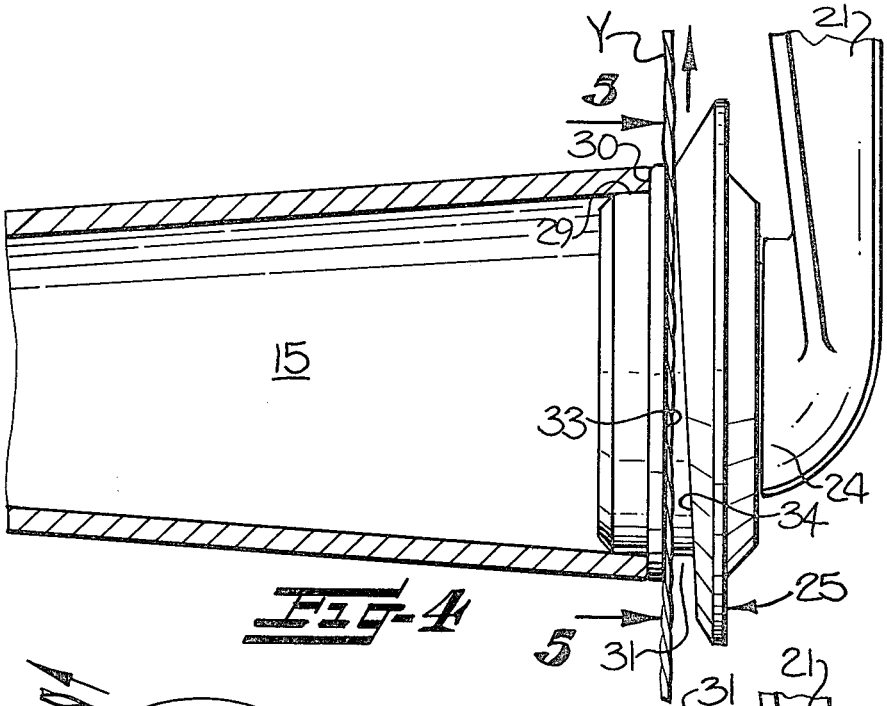
FIG. 4 is an enlarged fragmentary elevational view of a portion of the take-up mechanism and showing the centering plate of the present invention, with the yarn carrier tube mounted thereon and shown in cross-section.

As best seen in FIGS. 3 and 4, the centering plate 25 is provided with a circular hub 29 of a diameter corresponding to the inside diameter of one end of the carrier tube and which is adapted to extend axially into the end portion of the carrier tube 15 for thus holding the carrier tube in place. Adjoining the hub 29 is a larger diameter flange 30 which is adapted for engaging and seating against the endmost surface of the carrier tube 15. The centering plate 28 is also provided with a hub (not shown) and adjoining flange for engaging the opposite end of the carrier tube.

In order to wind a yarn onto the carrier tube 15 once the tube has been installed in place between the two centering plates 25, 26, the end of the yarn Y must be secured in some manner so that upon rotation of the carrier tube 15, the yarn will become wound thereabout. In accordance with the present invention, the centering plate 25 is of an improved construction for providing reliable, automatic or manual securement of a yarn end when initially winding the yarn onto the carrier tube. More particularly, as best seen in FIGS. 2–8, the centering plate 25 is provided with a circumferentially extending yarn securement channel 31 in which the yarn may be positioned, the yarn securement channel 31 being constructed for receiving the yarn Y and frictionally holding the yarn in place by a wedging or jamming action during rotation of the centering plate 25.

Referring more particularly to the construction of the centering plate 25, it will be noted that the channel 31 is defined by a pair of opposing side surfaces 33, 34 or walls. One surface or wall 33 is formed by an annular face of the flange 30, which face lies in a plane generally vertical or perpendicular to the rotational axis of the centering plate 25. The other surface or wall 34 lies in a plane extending obliquely to the axis of the centering plate 25 and thus results in the channel 31 being relatively wide at certain locations about the circumference and relatively narrow at other locations about the circumferential extent of the channel. The channel 31 thus has a narrowing cross-sectional area in the direction of rotation of the centering plate which serves to facilitate insertion of the yarn in the channel as well as to provide a highly effective wedging or jamming action on the yarn between the perpendicularly extending surface 33 and the obliquely extending surface 34 when the yarn is forcibly pulled into the channel and into a continuously narrowing portion thereof. It will be appreciated that this arrangement will accommodate and effectively secure yarns of widely varying weight and size.

The oblique surface 34 is preferably provided with means, such as grooves 35, for assisting in frictionally engaging a yarn positioned in the channel 31 and providing a jamming or wedging action thereon. The grooves 35 extend obliquely to the base of the channel 31 and angularly inwardly a direction opposite the direction of rotation of the centering plate 25.

Figure 5:
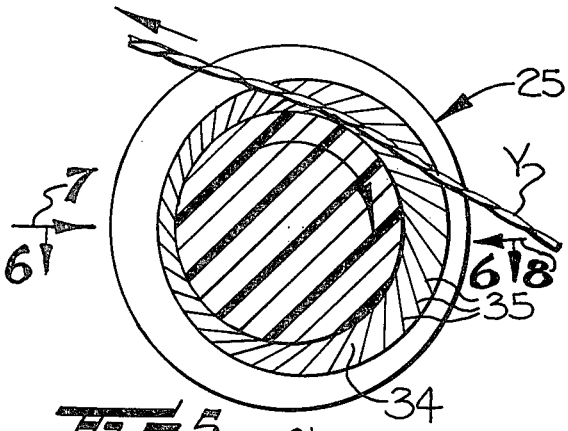
FIG. 5 is a cross-sectional view of the centering plate taken substantially along the line 5—5 of FIG. 4.

In order to initially secure the yarn end after an empty carrier tube 15 has been installed in the take-up assembly 14, the yarn Y is pulled across the centering plate 25 in the direction indicated by the arrow in FIGS. 4 and 5 so as to position the yarn in the channel 31. This may be accomplished either manually by an operator or automatically by an automatic yarn thread-up mechanism. Because of the decreasing cross-section of the channel 31 and the presence of the grooves 35 on the surface 34, the positioning of a yarn in the channel 31 in this manner will cause the yarn to become jammed or wedged between the opposing surfaces 33, 34 at some location along the circumferential extent of the channel 31, and the yarn may then be released by the operator or the yarn threading mechanism. This arrangement greatly facilitates automatic or manual threading of the take-up mechanism, since it permits the yarn to be secured either while the carrier tube 15 is still rotating, or while it is stationary. Thus, the cradle 17 may be constructed so as to lift the carrier tube 15 off the friction drive roll 16 during the thread-up operation, or if desired, the carrier tube 15 may be allowed to remain on the friction drive roll 16, with the drive roll 16 either rotating or stationary.

As best seen in FIGS. 4 and 6–8, the flange 30 is of a diameter which corresponds substantially to the outside diameter of the carrier tube 15. Thus, once the winding of the yarn begins and the yarn is picked up by the traversing guide 18, the flange 30 permits a smooth and unimpeded transfer of the yarn from the channel 31 to the carrier tube 15.

In the drawings and specification there has been set forth a preferred embodiment of the invention, and although specific terms are employed, they are used in a generic and descriptive sense only and not for purposes of limitation.

What is claimed is:

1. In a yarn take-up assembly including, in combination, a pair of opposing rotatably mounted centering plates and a yarn carrier tube positioned therebetween and supported for rotation for winding a yarn thereon, the improvement wherein one of said centering plates is of an improved construction for providing reliable automatic or manual securement of a yarn end during a thread-up operation, said improved centering plate comprising a hub extending axially into and supporting one end portion of said carrier tube and an adjoining larger diameter circumferential flange positioned in engagement with the end surface of the carrier tube for limiting axial movement thereof, and including a circumferential yarn securement channel located adjacent to said flange and defined by a pair of opposing circumferentially extending surfaces positioned for wedging and securing a yarn therebetween, with one of said surfaces lying in a plane perpendicular to the axis of the centering plate and comprising a perpendicularly extending face of said flange, and the other one of said surfaces of said channel lying in a plane oblique to the axis of the centering plate to thereby provide a narrowing cross-sectional area in said channel in the direction of rotation of the centering plate for wedging and securing a yarn therein and wherein said flange is of an outside diameter corresponding substantially to the outside diameter of said carrier tube to permit a smooth transfer of the yarn from said yarn securement channel to said carrier tube when the yarn is initially wound onto the carrier tube.

2. The invention as set forth in claim 1 wherein said other one of said surfaces of said channel is provided with grooves extending in a direction opposite the direction of rotation of the centering plate and slanting downwardly toward the base of said channel for aiding in clamping the yarn in said channel.

3. In a yarn take-up assembly including, in combination, a pair of opposing rotatably mounted centering plates and a yarn carrier tube positioned therebetween and supported for rotation for winding a yarn thereon, the improvement wherein one of said centering plates is of an improved construction for providing reliable automatic or manual securement of a yarn end during a thread-up operation, said improved centering plate comprising a circular hub of predetermined diameter extending axially into and supporting one end portion of said carrier tube and an adjoining larger diameter circumferential flange positioned in engagement with the end surface of the carrier tube for limiting axial movement thereof, and including a circumferential yarn securement channel located adjacent to said flange and defined by a pair of opposing circumferentially extending surfaces positioned for wedging and securing a yarn therebetween, one of said surfaces lying in a plane perpendicular to the axis of the centering plate and comprising a perpendicularly extending face of said flange, the other surface lying in a plane oblique to the axis of the centering plate to thereby provide a narrowing cross-sectional area in said channel in the direction of rotation of the centering plate for wedging and securing the yarn therein, and said other surface being provided with grooves extending in a direction opposite the direction of rotation of the centering plate and slanting downwardly toward the base of said channel for aiding in clamping the yarn in said channel, and wherein said flange is of an outside diameter corresponding substantially to the outside diameter of said carrier tube to permit a smooth transfer of the yarn from said yarn securement channel to said carrier tube when the yarn is initially wound onto the carrier tube.

4. A centering plate for rotatably supporting a yarn carrier tube and characterized by an improved construction for providing reliable automatic or manual securement of a yarn end during a thread-up operation, said centering plate comprising a hub of predetermined size for extending axially into and supporting one end portion of the carrier tube, and an adjoining larger diameter circumferential flange for engaging the end surface of the carrier tube and limiting axial movement thereof, and including a circumferential yarn securement channel located adjacent to said flange and defined by a pair of opposing circumferentially extending surfaces positioned for wedging and securing a yarn therebetween, with one of said surfaces lying in a plane perpendicular to the axis of the centering plate and comprising a perpendicularly extending face of said flange, and the other one of said surfaces of said channel lying in a plane oblique to the axis of the centering plate to thereby provide a narrowing cross-sectional area in said channel in the direction of rotation of the centering plate for wedging and securing a yarn therein, and wherein said flange is of an outside diameter corresponding substantially to the outside diameter of said carrier tube to permit a smooth transfer of the yarn from said yarn securement channel to said carrier tube when the yarn is initially wound onto the carrier tube.

5. The invention as set forth in claim 4 wherein said other one of said surfaces of said channel is provided with grooves extending in a direction opposite the direction of rotation of the centering plate and slanting downwardly, toward the base of said channel for aiding in clamping the yarn in said channel.

6. A centering plate for rotatably supporting a yarn carrier tube and characterized by an improved construction for providing reliable automatic or manual securement of a yarn end during a thread-up operation, said centering plate comprising a circular hub of predetermined diameter for extending axially into and supporting one end portion of the carrier tube, and an adjoining larger diameter circumferential flange for engaging the end surface of the carrier tube and limiting axial movement thereof, and including a circumferential yarn securement channel located adjacent to said flange and defined by a pair of opposing circumferentially extending surfaces positioned for wedging and securing a yarn therebetween, one of said surfaces extending perpendicular to the axis of the centering plate and comprising a perpendicularly extending face of said flange, the other surface lying in a plane oblique to the axis of the centering plate to thereby provide a narrowing cross-sectional area in said channel in the direction of rotation of the centering plate for wedging and securing a yarn therein, and said other surface being provided with grooves extending in a direction opposite the direction of rotation of the centering plate and slanting downwardly toward the base of said channel for aiding in clamping the yarn in said channel, and wherein said flange is of an outside diameter corresponding substantially to the outside diameter of the carrier tube to permit a smooth transfer of the yarn from said yarn securement channel to the carrier tube when the yarn is initially wound onto the carrier tube.

* * * * *